US010001723B2

(12) United States Patent
Arai

(10) Patent No.: US 10,001,723 B2
(45) Date of Patent: Jun. 19, 2018

(54) TONER CASE AND IMAGE FORMING APPARATUS WITH A VIBRATING COIL SPRING IN A TONER COMMUNICATION SPACE

(71) Applicant: KYOCERA Document Solutions Inc., Osaka (JP)

(72) Inventor: Takaaki Arai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/622,150

(22) Filed: Jun. 14, 2017

(65) Prior Publication Data

US 2018/0011420 A1 Jan. 11, 2018

(30) Foreign Application Priority Data

Jul. 7, 2016 (JP) ..... 2016-135135

(51) Int. Cl.
*G03G 15/01* (2006.01)
*G03G 15/08* (2006.01)

(52) U.S. Cl.
CPC ..... *G03G 15/0837* (2013.01); *G03G 15/0142* (2013.01); *G03G 15/0843* (2013.01); *G03G 15/0121* (2013.01); *G03G 15/081* (2013.01); *G03G 15/087* (2013.01); *G03G 15/0836* (2013.01); *G03G 15/0867* (2013.01); *G03G 15/0868* (2013.01); *G03G 15/0872* (2013.01); *G03G 15/0877* (2013.01); *G03G 15/0889* (2013.01); *G03G 15/0896* (2013.01); *G03G 2215/0154* (2013.01)

(58) Field of Classification Search
CPC ..... G03G 15/0121; G03G 15/0142; G03G 15/081; G03G 15/0836; G03G 15/0837; G03G 15/0843; G03G 15/0867; G03G 15/0868; G03G 15/087; G03G 15/0872; G03G 15/0877; G03G 15/0889; G03G 15/0896; G03G 2215/0154
See application file for complete search history.

(56) References Cited

U.S. PATENT DOCUMENTS

| | | | | |
|---|---|---|---|---|
| 7,720,416 | B2 | 5/2010 | Taguchi et al. | |
| 7,747,202 | B2 | 6/2010 | Taguchi et al. | |
| 7,840,167 | B2 | 11/2010 | Taguchi et al. | |
| 8,121,525 | B2 | 2/2012 | Taguchi et al. | |
| 8,396,398 | B2 | 3/2013 | Taguchi et al. | |
| 2008/0124119 | A1* | 5/2008 | Oda | G03G 15/0898 399/120 |

(Continued)

FOREIGN PATENT DOCUMENTS

JP 2006-071762 A 3/2006

*Primary Examiner* — Joseph S Wong
(74) *Attorney, Agent, or Firm* — Studebaker & Brackett PC

(57) ABSTRACT

A toner case includes a case main body, a cover, and a coil spring. The case main body is rotatable and has a toner containing space in which a toner is contained and an opening through which the toner is discharged from the toner containing space. The cover keeps a rotation stop state when the case main body rotates and has a communication space which communicates with the toner containing space via the opening. The coil spring is fixed to the cover so that at least a part of the coil spring is arranged in the communication space. The coil spring vibrates as the case main body rotates.

10 Claims, 8 Drawing Sheets

(56) References Cited

U.S. PATENT DOCUMENTS

| | | | | |
|---|---|---|---|---|
| 2011/0243579 | A1* | 10/2011 | Oshikawa | G03G 21/1875 399/12 |
| 2014/0270859 | A1* | 9/2014 | Hosokawa | G03G 15/0872 399/262 |

* cited by examiner

TONER CASE AND IMAGE FORMING APPARATUS WITH A VIBRATING COIL SPRING IN A TONER COMMUNICATION SPACE

INCORPORATION BY REFERENCE

This application is based on and claims the benefit of priority from Japanese Patent application No. 2016-135135 filed on Jul. 7, 2016, which is incorporated by reference in its entirety.

BACKGROUND

The present disclosure relates to a toner case and an image forming apparatus including the toner case.

An image forming apparatus, such as a printer, a copying machine, a facsimile, or a multi-function peripheral (MFP), forms a toner image by supplying a toner (developer) from a development device to an image carrier, such as a photosensitive drum. Commonly, the toner used for forming the toner image is supplied from a toner case, such as a toner cartridge or a toner bottle, to the development device.

For example, there is a toner bottle including a bottle main body and a cap which is attached to an inlet of the bottle main body. When the toner is aggregated in the cap in such a toner bottle, there is a concern that a toner supplying port arranged in the cap is narrowed or closed by the toner, and toner supply from the toner bottle to a development device becomes unstable. When the toner supply becomes unstable as described above, there is a concern that a toner concentration is varied and image deterioration, such as blurring or unevenness in color, occurs.

Hence, the above toner bottle includes an agitator which rotates with the bottle main body and agitates the toner in the cap so as to prevent aggregation of the toner in the cap.

SUMMARY

In accordance with an aspect of the present disclosure, a toner case includes a case main body, a cover, and a coil spring. The case main body is rotatable and has a toner containing space in which a toner is contained and an opening through which the toner is discharged from the toner containing space. The cover keeps a rotation stop state when the case main body rotates and has a communication space which communicates with the toner containing space via the opening. The coil spring is fixed to the cover so that at least a part of the coil spring is arranged in the communication space. The coil spring vibrates as the case main body rotates.

In accordance with an aspect of the present disclosure, an image forming apparatus includes the above toner case.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Hereinafter, with reference to the drawings, an MFP 1 (image forming apparatus) according to a first embodiment of the present disclosure will be described. Arrows Fr, Rr, L, R, U, and Lo optionally added to each drawing indicate a front side, a rear side, a left side, a right side, an upper side, and a lower side of the MFP 1, respectively.

First, a whole structure of the MFP 1 will be described.

Figure 1:
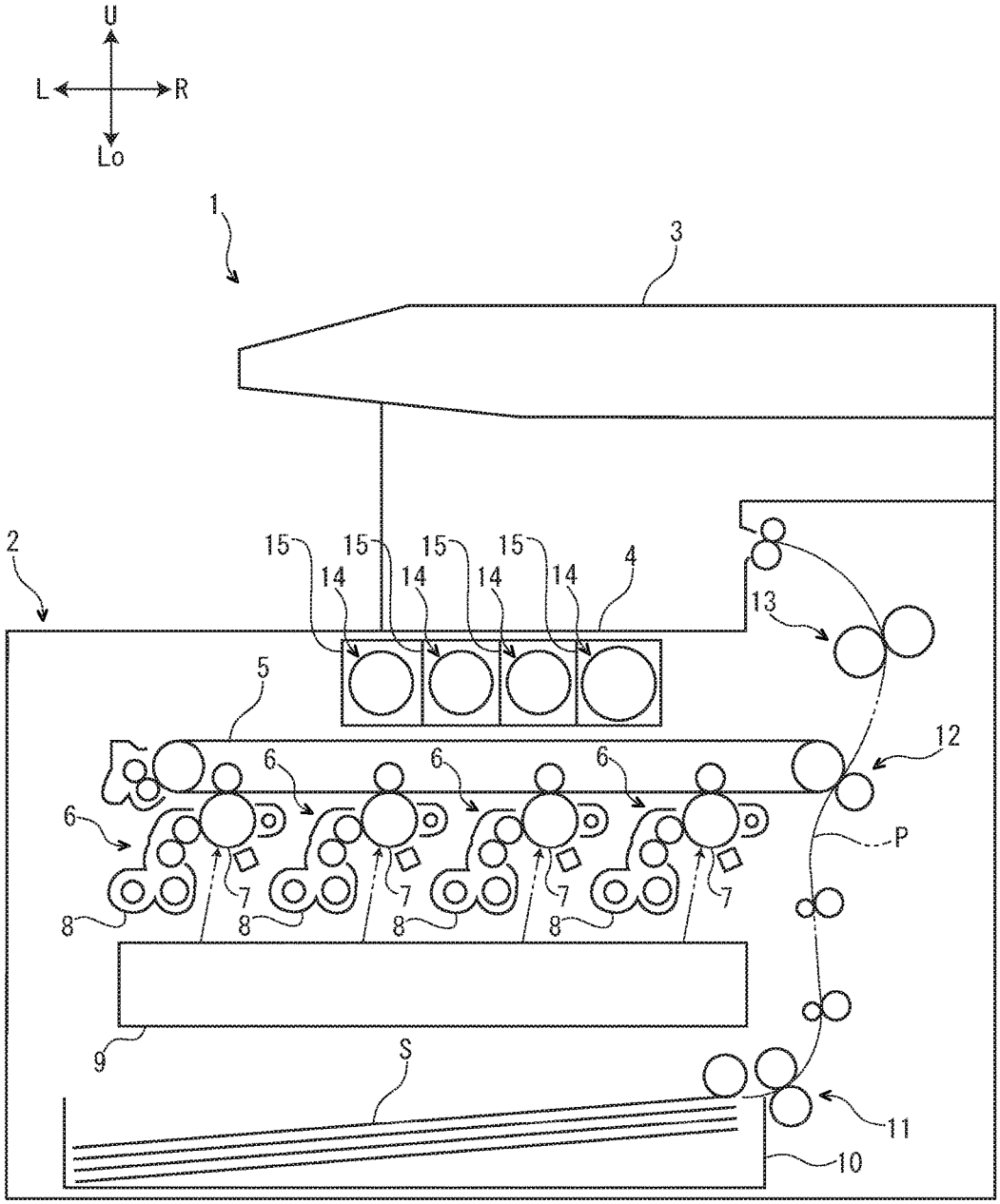
FIG. 1 is a schematic view showing a multi-function peripheral (MFP) according to a first embodiment of the present disclosure.

As shown in FIG. 1, the MFP 1 includes a box-formed MFP main body 2 (apparatus main body). In an upper end part of the MFP main body 2, an image reading device 3 to read an original image is arranged. In an upper part of the MFP main body 2, a sheet ejecting tray 4 is arranged. In a roughly center part of the MFP main body 2, an intermediate transfer belt 5 and four image forming parts 6 are housed. Each image forming part 6 corresponds to a toner (developer) of black, cyan, magenta, and yellow, in order from a right side to a left side. Each image forming part 6 includes a photosensitive drum 7 (image carrier) and a development device 8. In a lower part of the MFP main body 2, an exposure device 9 is housed. In a lower end part of the MFP main body 2, a sheet feeding tray 10 in which a sheet S (recording medium) is accommodated is housed.

At a right side part of the MFP main body 2, a conveying path P of the sheet S is arranged. At an upstream end part of the conveying path P, a sheet feeding part 11 is arranged. At an intermediate stream part of the conveying path P, a secondary transfer part 12 is arranged. At a downstream part of the conveying path P, a fixing device 13 is arranged.

In the upper part of the MFP main body 2, four toner bottles 14 (toner cases) and four attachment parts 15 are arranged below the sheet ejecting tray 4. Each toner bottle 14 is detachably attached to each attachment part 15. Each toner bottle 14 corresponds to the toner of black, cyan, magenta, and yellow, in order from a right side to a left side.

Next, an operation of the MFP 1 will be described.

First, an electrostatic latent image is formed on a surface of the photosensitive drum 7 of each image forming part 6 by a light (refer to a two-dot chain arrow in FIG. 1) from the exposure device 9. The electrostatic latent image is developed to a toner image by the development device 8 of each image forming part 6. The toner image is primarily transferred from the photosensitive drum 7 of each image forming part 6 to the intermediate transfer belt 5. Accordingly, a full-color toner image is formed on the intermediate transfer belt 5.

Further, the sheet S picked from the sheet feeding tray 10 by the sheet feeding part 11 is conveyed to a downstream side of the conveying path P and enters the secondary transfer part 12. In the secondary transfer part 12, the full-color toner image formed on the intermediate transfer belt 5 is secondarily transferred to the sheet S. The sheet S to which the toner image is secondarily transferred is further conveyed to the downstream side of the conveying path P and enters the fixing device 13. In the fixing device 13, the toner image is fixed to the sheet S. The sheet S to which the toner image is fixed is ejected on the sheet ejecting tray 4.

Next, each toner bottle 14 will be further described.

Incidentally, a configuration of each toner bottle 14 is the same. Therefore, the black toner bottle 14 (the toner bottle 14 arranged at a rightmost side in FIG. 1) will be described and descriptions of the cyan, magenta, and yellow toner bottles 14 will be omitted. Hereinafter, "the toner bottle 14" refers to the black toner bottle 14. An arrow I optionally assigned to FIG. 2 and its subsequent drawings indicates an inside in a front-and-back direction of the toner bottle 14, and an arrow O optionally assigned to FIG. 2 and its subsequent drawings indicates an outside in the front-and-back direction of the toner bottle 14.

Figure 2:
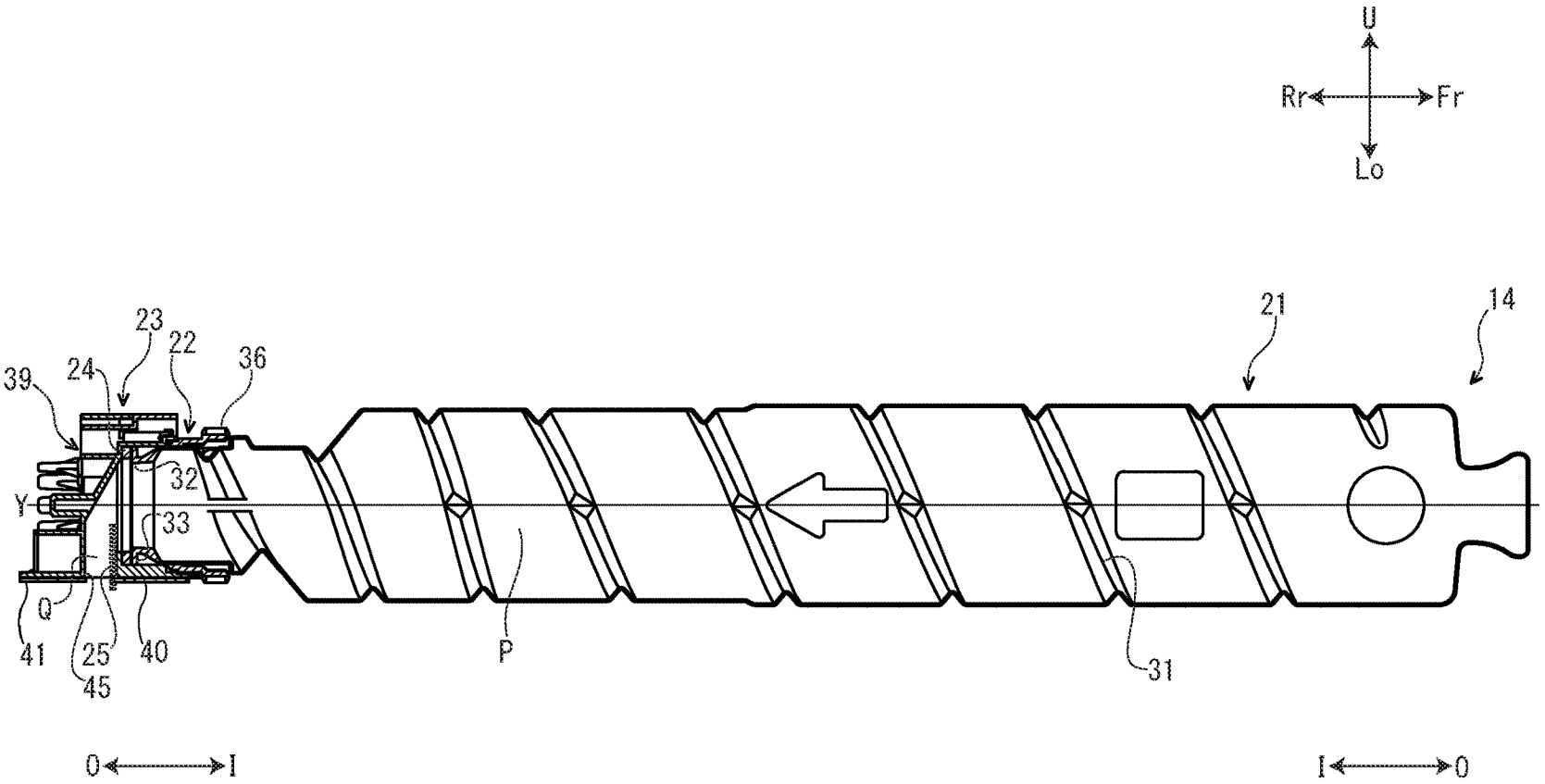
FIG. 2 is a sectional view showing a toner bottle according to the first embodiment of the present disclosure.

As shown in FIG. 2 and other figures, the toner bottle 14 includes a case main body 21, a transmission member 22 which is attached to a rear part of the case main body 21, a cover 23 which is arranged at a rear side of the transmission member 22, a seal member 24 which is accommodated in a substantial center of the cover 23, and a coil spring 25 which is arranged at a rear side of the seal member 24. Hereinafter, these members will be described in order.

First, the case main body 21 of the toner bottle 14 will be described.

The case main body 21 is formed in a cylindrical shape which is long in the front-and-back direction. That is, in the present embodiment, the front-and-back direction is a longitudinal direction of the case main body 21. The case main body 21 is rotatable around a rotation axis Y extending in the front-and-back direction. That is, in the present embodiment, the front-and-back direction is a rotation axis direction of the case main body 21. The case main body 21 is set so that the rotation axis Y is substantially horizontal.

Inside the case main body 21, the toner containing space P is formed. In the toner containing space P, the black toner (not shown) is contained. On an inner circumferential face of the case main body 21, one spiral conveying rib 31 is continuously arranged.

Figure 3:
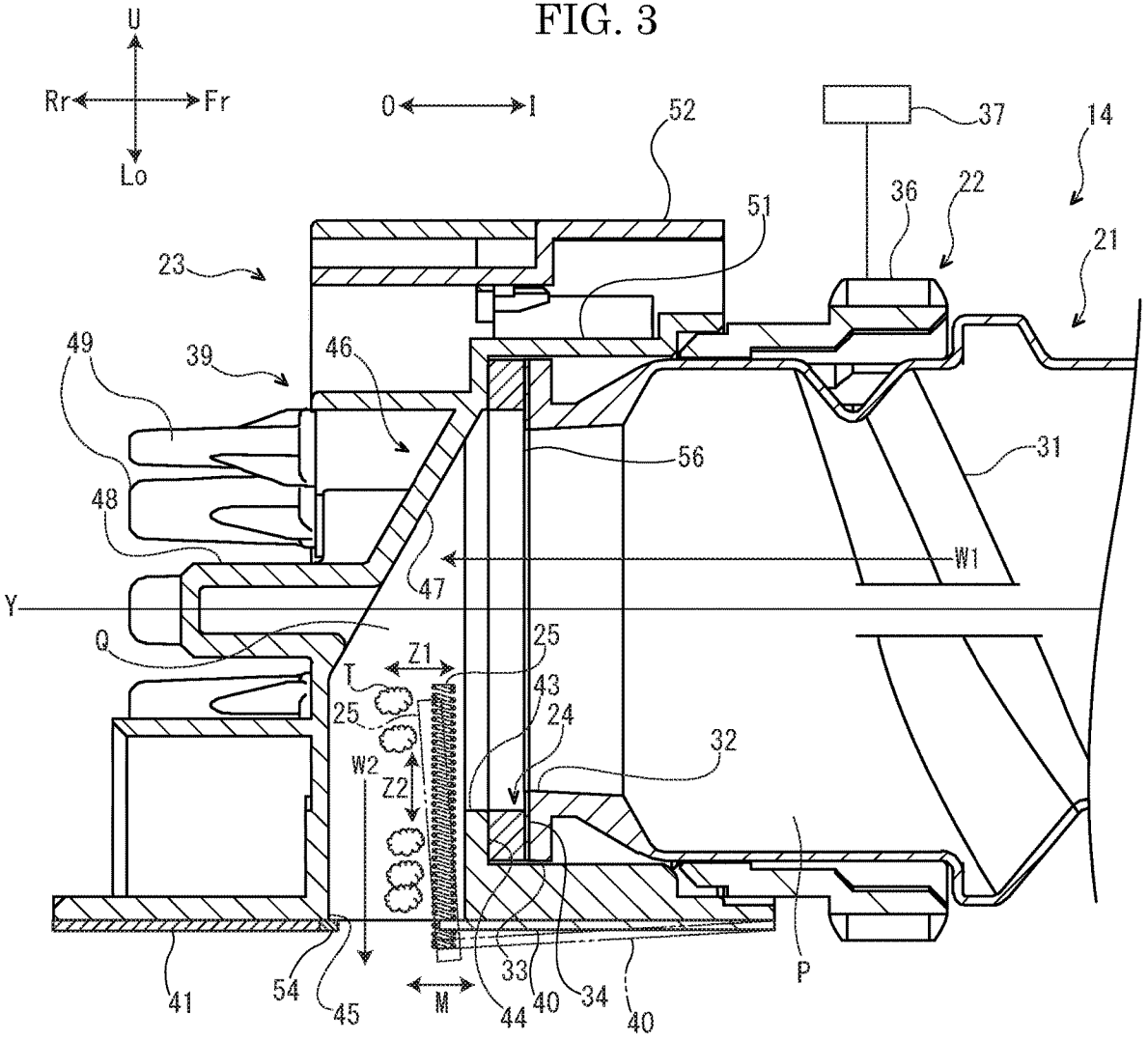
FIG. 3 is a sectional view showing a state where a shutter is in an opening position, in the toner bottle according to the first embodiment of the present disclosure.

As shown in FIG. 3 and other figures, at a rear end of the case main body 21, a circular opening 32 is arranged. The inner diameter of the opening 32 is smaller than an inner diameter of a part of the case main body 21 where the conveying rib 31 is arranged. At an outer circumference of the opening 32, an annular flange 33 is arranged. To a rear face of the flange 33 (corresponding to a rear end face of the entire case main body 21), a sliding contact member 34 is fixed. The sliding contact member 34 is formed by using a material (e.g. a resin film) of a lower friction coefficient than that of the case main body 21.

Next, the transmission member 22 of the toner bottle 14 will be described.

The transmission member 22 is formed in a cylindrical shape around the rotation axis Y. The transmission member 22 is attached to an outer circumferential face of the case main body 21, and rotates integrally with the case main body 21 around the rotation axis Y. On an outer circumferential face of the transmission member 22, a transmission gear 36 is arranged. The transmission gear 36 is connected to a drive source 37 composed of a motor via a gear train (not shown).

Next, the cover 23 of the toner bottle 14 will be described.

The cover 23 includes a cover main body 39, a shutter 40 which is arranged at a lower end side of the cover main body 39 and a fixed piece 41 which is arranged at a rear side of the shutter 40.

The cover main body 39 of the cover 23 covers the opening 32 of the case main body 21. Inside the cover main body 39, a communication space Q is formed. The communication space Q communicates with the toner containing space P of the case main body 21 via the opening 32. The communication space Q extends along an up-and-down direction. The cover main body 39 has a toner introducing port 43 at a front side of the communication space Q. The cover main body 39 includes an annular base 44 around the toner introducing port 43. The cover main body 39 includes a toner supplying port 45 at a lower end side of the communication space Q.

At a rear part of the cover main body 39 of the cover 23, a cover part 46 is arranged. The cover part 46 covers a rear side of the communication space Q. The cover part 46 is arranged at a side opposite to the toner introducing port 43 across the communication space Q. At an upper part of the cover part 46, an inclined wall 47 is arranged. The inclined wall 47 inclines downward to the rear side. The cover part 46 includes a cylindrical boss 48 at a lower side of the inclined wall 47. The boss 48 extends along a horizontal direction toward the rear side (a side separating from the communication space Q). An axial center of the boss 48 matches with the rotation axis Y. The boss 48 opens toward the front side (a side of the communication space Q). Around the boss 48, a plurality of regulating plates 49 are arranged.

At a front part of the cover main body 39 of the cover 23, a holder 51 is arranged. The holder 51 is arranged at a front side of the communication space Q. The holder 51 extends from the base 44 toward the front side. The holder 51 holds the flange 33 of the case main body 21.

At an upper part of the cover main body 39 of the cover 23, a support 52 is arranged. The support 52 is arranged above the communication space Q. The support 52 supports a pair of left and right levers (not shown).

Figure 4:
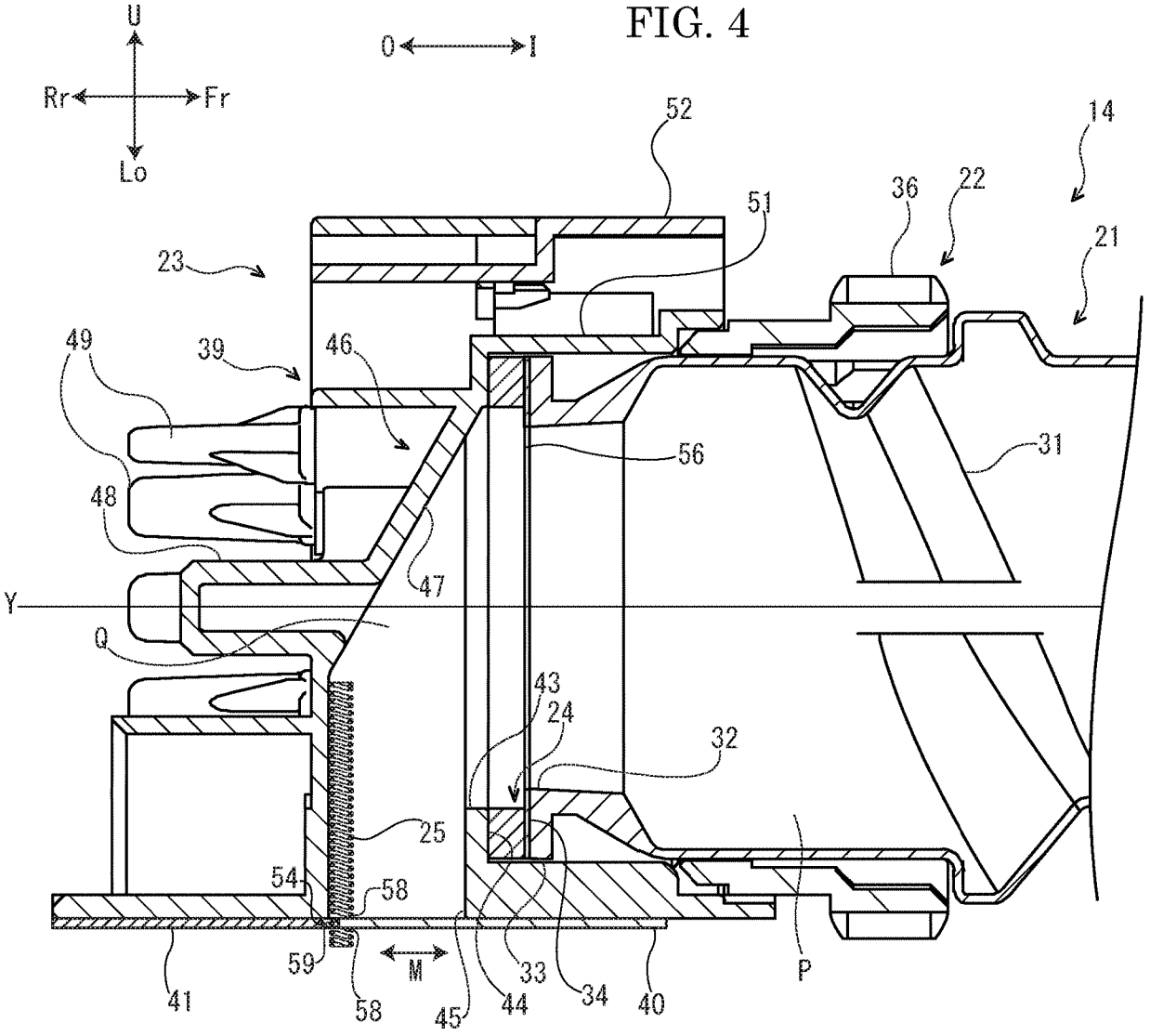
FIG. 4 is a sectional view showing a state where the shutter is in a closing position, in the toner bottle according to the first embodiment of the present disclosure.

The shutter 40 of the cover 23 is arranged along the horizontal direction. The shutter 40 is movable along the front-and-back direction (horizontal direction) between an opening position (see FIG. 3) where the shutter 40 opens the toner supplying port 45, and a closing position (see FIG. 4) where the shutter 40 closes the toner supplying port 45. Incidentally, arrows M in FIGS. 3 and 4 indicate a movement direction of the shutter 40.

As shown in FIG. 3 and other figures, the fixed piece 41 of the cover 23 is fixed to a lower face of the cover main body 39. At a front end of the fixed piece 41, a seal 54 is fixed along the toner supplying port 45. The seal 54 is formed by using an elastic member, for example.

Next, the seal member 24 of the toner bottle 14 will be described.

The seal member 24 is formed in an annular shape. The seal member 24 is fixed to a front face of the base 44 of the cover main body 39. The seal member 24 is interposed between the sliding contact member 34 and the base 44 in a compressed state. The seal member 24 is partially or entirely formed by using an elastic material, such as urethane foam.

Next, the coil spring 25 of the toner bottle 14 will be described.

Figure 5:
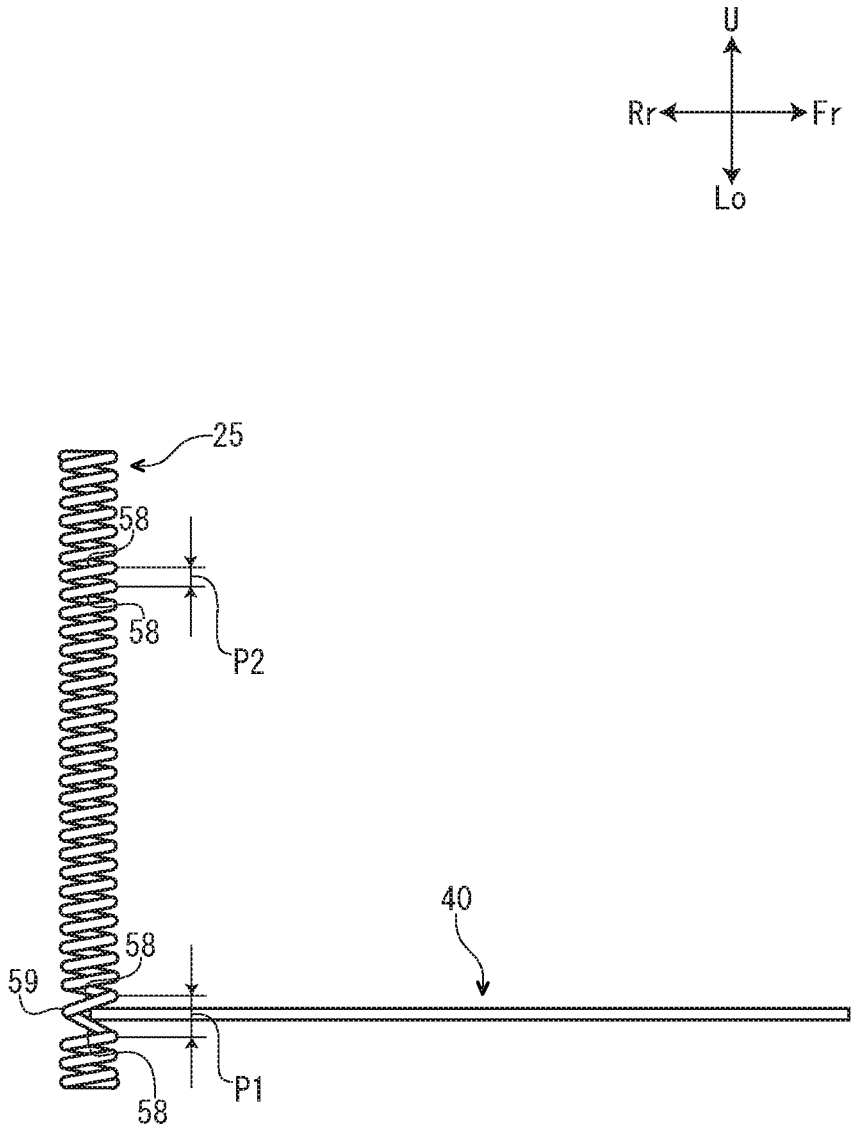
FIG. 5 is a side view showing the shutter and a coil spring, in the toner bottle according to the first embodiment of the present disclosure.

As shown in FIG. 5 and other figures, the coil spring 25 is formed in a linear shape. As the coil spring 25, the same spring as a coil spring for a ballpoint pen can be used. The coil spring 25 is formed by using a spring stainless steel wire (SUS304-WPB) whose wire diameter is approximately 0.25 mm. Of course, the wire diameter and a material of the coil spring 25 are not limited to the above. Further, a spring constant (N/mm) of the coil spring 25 is not limited to a spring constant matching the above-mentioned wire diameter and the material, either.

Figure 6A:
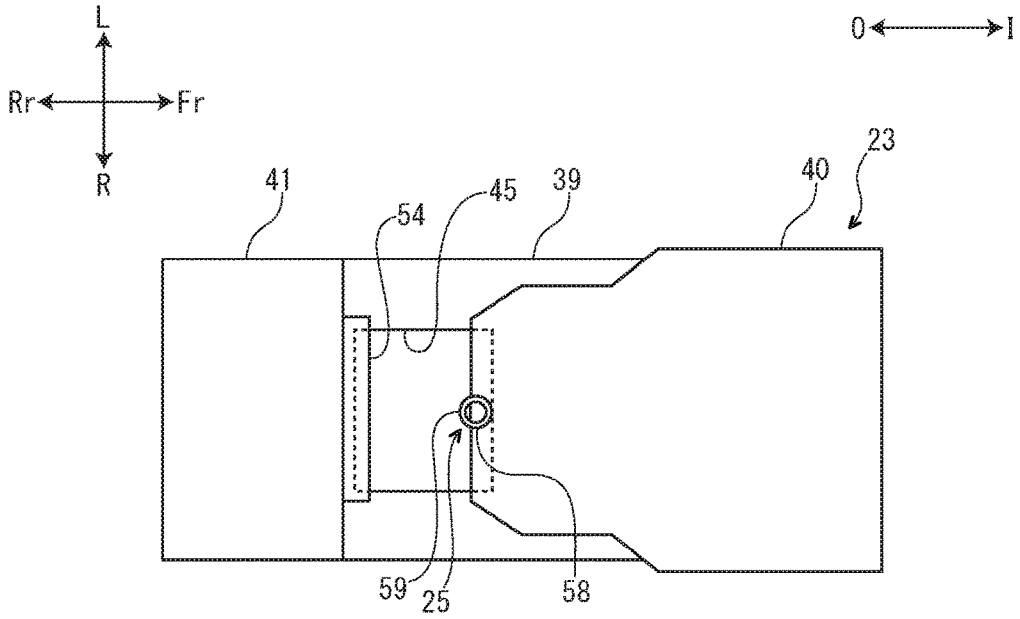
FIG. 6A is a bottom view showing the state where the shutter is in the opening position, in the toner bottle according to the first embodiment of the present disclosure.
Figure 6B:
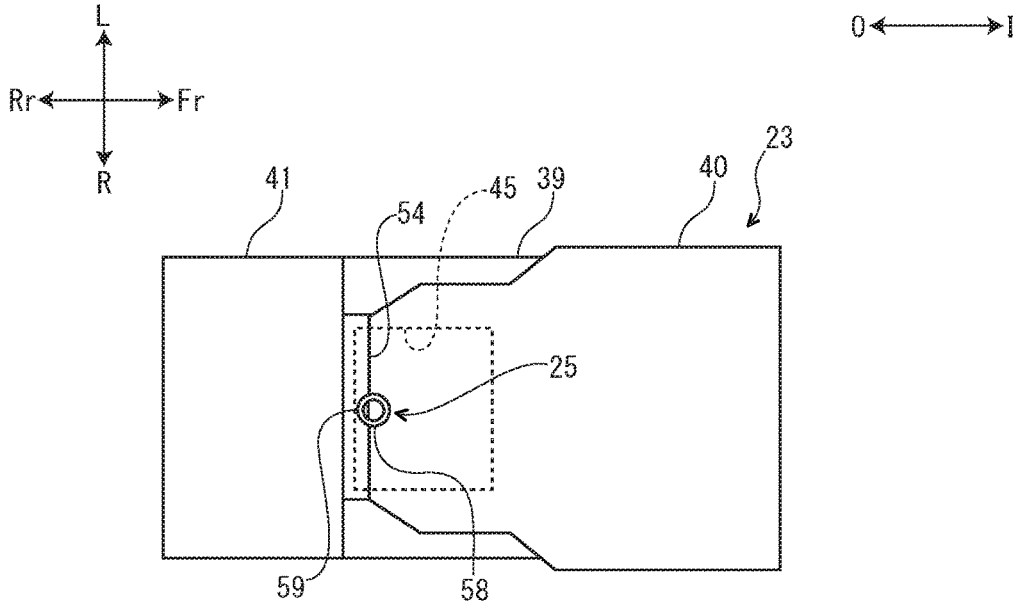
FIG. 6B is a bottom view showing the state where the shutter is in the closing position, in the toner bottle according to the first embodiment of the present disclosure.

The coil spring 25 is arranged vertically with respect to the shutter 40. A pair of wound parts 58 which lies next to each other nips a rear end (distal end) of the shutter 40, so that a lower part of the coil spring 25 is fixed to the shutter 40. A winding interval P1 between the pair of wound parts 58 which nips the rear end of the shutter 40 is adjusted so as to be wider than a winding interval P2 between the pair of wound parts 58 which does not nip the rear end of the shutter 40. A border 59 between the pair of wound parts 58 which nips the rear end of the shutter 40 is arranged at a rear side (distal end side) of the rear end of the shutter 40. The border 59 is configured to separate from the seal 54 in a state where the shutter 40 is in the opening position (see FIG. 6A) and to come into contact with the seal 54 in a state where the shutter 40 is in the closing position (see FIG. 6B). According to this, toner leakage from the toner supplying port 45 in a state where the shutter 40 is in the closing position is suppressed.

As shown in FIG. 3 and other figures, the coil spring 25 extends from the toner supplying port 45 to the communication space Q along the up-and-down direction. The one coil spring 25 is arranged near a center in a left-and-right direction of the toner supplying port 45. The coil spring 25 protrudes upward from the toner supplying port 45. The coil spring 25 is not in contact with the cover main body 39 in the state where the shutter 40 is in the opening position (see FIG. 3), and opposes to a front rim of the toner supplying port 45 at an interval. A lower end of the coil spring 25 protrudes below the toner supplying port 45. An upper part of the coil spring 25 is arranged in the communication space Q, and is arranged above a lower end of the toner introducing port 43.

Operation of supplying the toner to the development device 8 of the black image forming part 6 (the image forming part 6 arranged at the rightmost side in FIG. 1) in the MFP 1 configured as mentioned above will be described below. Incidentally, operation of supplying the toner to the development devices 8 of the cyan, magenta, and yellow image forming parts 6 is the same as the operation of supplying the toner to the development device 8 of the black image forming part 6, and therefore the description thereof will be omitted. Hereinafter, "the image forming part 6" refers to the black image forming part 6.

To supply the toner to the development device 8 of the image forming part 6, the drive source 37 is driven in the state where the shutter 40 is in the opening position (see FIG. 3). When the drive source 37 is driven in this way, rotation drive force from the drive source 37 is transmitted to the transmission member 22 via the gear train (not shown), and the transmission member 22 rotates. As the transmission member 22 rotates in this way, the case main body 21 rotates integrally with the transmission member 22 accordingly. That is, the transmission member 22 transmits the rotation drive force from the drive source 37 to the case main body 21. Incidentally, even when the case main body 21 rotates as mentioned above, the cover 23, the seal member 24, and the coil spring 25 do not rotate and keep a rotation stop state.

As the case main body 21 rotates as mentioned above, as indicated by an arrow W1 in FIG. 3, the conveying rib 31 of the case main body 21 conveys the toner in the toner containing space P from the front side to the rear side along the horizontal direction, so that the toner is discharged from the toner containing space P via the opening 32. The toner discharged from the toner containing space P via the opening 32 is introduced in the communication space Q via the toner introducing port 43. As indicated by an arrow W2 in FIG. 3, the toner introduced in the communication space Q in this way is discharged from the communication space Q via the toner supplying port 45. The toner discharged from the communication space Q via the toner supplying port 45 in this way is supplied to the development device 8 of the image forming part 6 (see FIG. 1).

By the way, when the toner is aggregated in the communication space Q in the toner bottle 14 configured as mentioned above, and aggregated particles T (see FIG. 3) are produced, there is a concern that the aggregated particles T narrow or close the toner supplying port 45, and toner supply from the toner bottle 14 to the development device 8 of the image forming part 6 becomes unstable. When the toner supply becomes unstable as described above, there is a concern that a toner concentration is varied and image deterioration, such as blurring or unevenness in color, occurs. Particularly, since the toner bottle 14 according to the present embodiment employs a configuration to convey the toner in the toner containing space P along the horizontal direction, the toner supply is likely to become unstable when the remaining toner amount in the toner containing space P becomes small. Hence, in the present embodiment, such a trouble is prevented as follows.

As the case main body 21 rotates during the toner supply as mentioned above, this rotation vibrates the case main body 21. The vibration of the case main body 21 is transmitted to the shutter 40 via the cover main body 39, and the shutter 40 vibrates (see a two-dot chain line FIG. 3). When the shutter 40 vibrates in this way, the coil spring 25 fixed to the shutter 40 vibrates in the front-and-back direction and the up-and-down direction (see arrows Z1 and Z2 in FIG. 3). According to this, the aggregated particles T in the communication space Q are resolved, and consequently can be discharged from the toner supplying port 45. Consequently, it is possible to prevent the aggregated particles T from narrowing and closing the toner supplying port 45, to stabilize the toner supply from the toner bottle 14 to the development device 8 of the image forming part 6, and to prevent image deterioration due to variations of the toner concentration.

Particularly, by vibrating the coil spring 25 as mentioned above, the steel wire composing the coil spring 25 can receive the aggregated particles T not "planarly" but "linearly", and can resolve the aggregated particles T by cutting them. By contrast with this, when a plate member (e.g. a resin plate or a metal plate) or a film member is vibrated, the aggregated particles T accumulate on a face of the plate member or the film member, and therefore cannot be sufficiently resolved. Thus, in the present embodiment, the coil spring 25 is vibrated to improve an effect of resolving the aggregated particles T compared to a case where the plate member or the film member is vibrated.

Further, the vibration of the coil spring 25 is used as mentioned above to resolve the aggregated particles T in the communication space Q, so that it is not necessary to arrange a member with a complicated configuration to resolve the aggregated particles T in the communication space Q. Consequently, it is possible to simplify the configuration of the toner bottle 14, and suppress a rise in manufacturing cost of the toner bottle 14.

Further, the coil spring 25 is fixed to the shutter 40, so that the vibration of the cover main body 39 can be amplified by the shutter 40 and transmitted to the coil spring 25. Consequently, it is possible to increase the amplitude of the vibration of the coil spring 25 and to further enhance an effect of resolving the aggregated particles T in the communication space Q.

Further, the toner supplying port 45 is arranged at the lower end side of the communication space Q, the shutter 40 is arranged along the horizontal direction, and the coil spring 25 extends from the toner supplying port 45 to the communication space Q along the up-and-down direction. By employing such a configuration, it is possible to efficiently resolve the aggregated particles T in the communication space Q by using the linear coil spring 25.

Further, the pair of wound parts 58 which lies next to each other nips the rear end of the shutter 40 so that the coil spring 25 is fixed to the shutter 40. By employing such a configuration, it is possible to easily fix the coil spring 25 to the shutter 40 without using an adhesive or the like.

Figure 7:
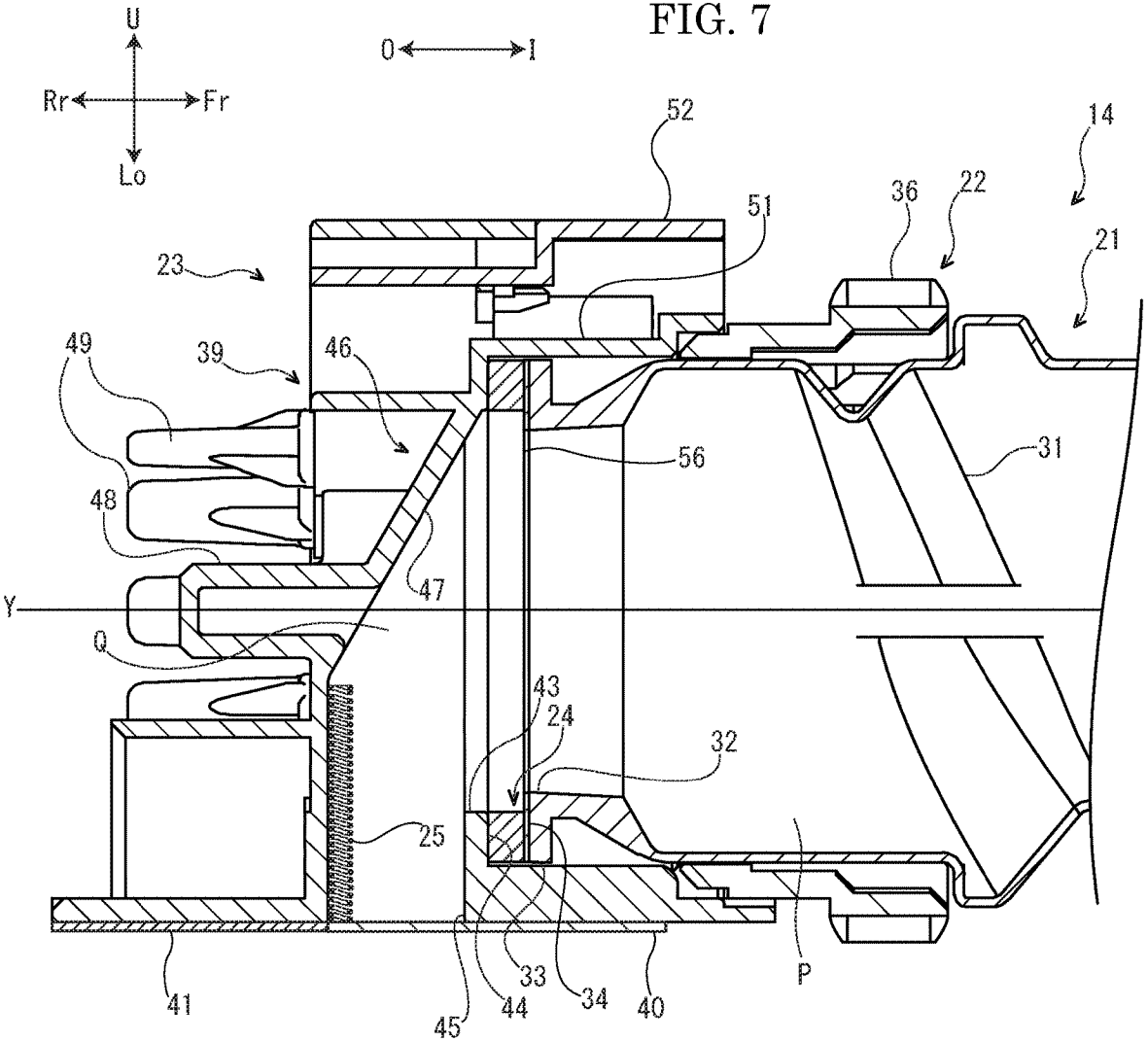
FIG. 7 is a sectional view showing a state where a shutter is in a closing position, in a toner bottle according to another embodiment of the present disclosure.

In the present embodiment, the case where the pair of wound parts 58 which lies next to each other nips the rear end of the shutter 40 so that the coil spring 25 is fixed to the shutter 40 has been described. Meanwhile, in another embodiment, as shown in FIG. 7, the lower end of the coil spring 25 may be fixed to an upper face (a face in a side of the communication space Q) of the shutter 40. By employing such a configuration, it is possible to prevent a part of the coil spring 25 from being nipped between the shutter 40 and the fixed piece 41 in the state where the shutter 40 is in the closing position and to reliably prevent toner leakage from the toner supplying port 45.

In the present embodiment, the case where the seal 54 is fixed to the front end of the fixed piece 41 has been described. Meanwhile, in another embodiment, as shown in FIG. 7, the seal 54 may not be fixed to the front end of the fixed piece 41.

In the present embodiment, the case where the coil spring 25 does not come into contact with the cover main body 39 in the state where the shutter 40 is in the opening position (see FIG. 3) has been described. Meanwhile, in another embodiment, the coil spring 25 may come into contact with the cover main body 39 in the state where the shutter 40 is in the opening position.

In the present embodiment, the case where the coil spring 25 is fixed to the rear end (distal end) of the shutter 40 has been described. Meanwhile, in another embodiment, a center or a proximal end of the shutter 40 may be fixed to the coil spring 25.

In the present embodiment, the case where the one coil spring 25 is arranged has been described. Meanwhile, in another embodiment, a plurality of coil springs 25 may be arranged. Incidentally, the number of coil springs 25 is preferably two or less to prevent the coil springs 25 from excessively narrowing the communication space Q and the toner supplying port 45.

In the present embodiment, the case where the configuration according to the present disclosure is applied to the MFP 1 has been described. However, in another embodiment, the configuration according to the present disclosure may be applied to an image forming apparatus other than the MFP 1, such as a printer, a copy machine or a facsimile.

Second Embodiment

Next, a toner bottle 61 according to a second embodiment of the present disclosure will be described. Incidentally, configurations of members other than a coil spring 62 are the same as those of the first embodiment, and therefore their descriptions will be omitted.

Figure 8:
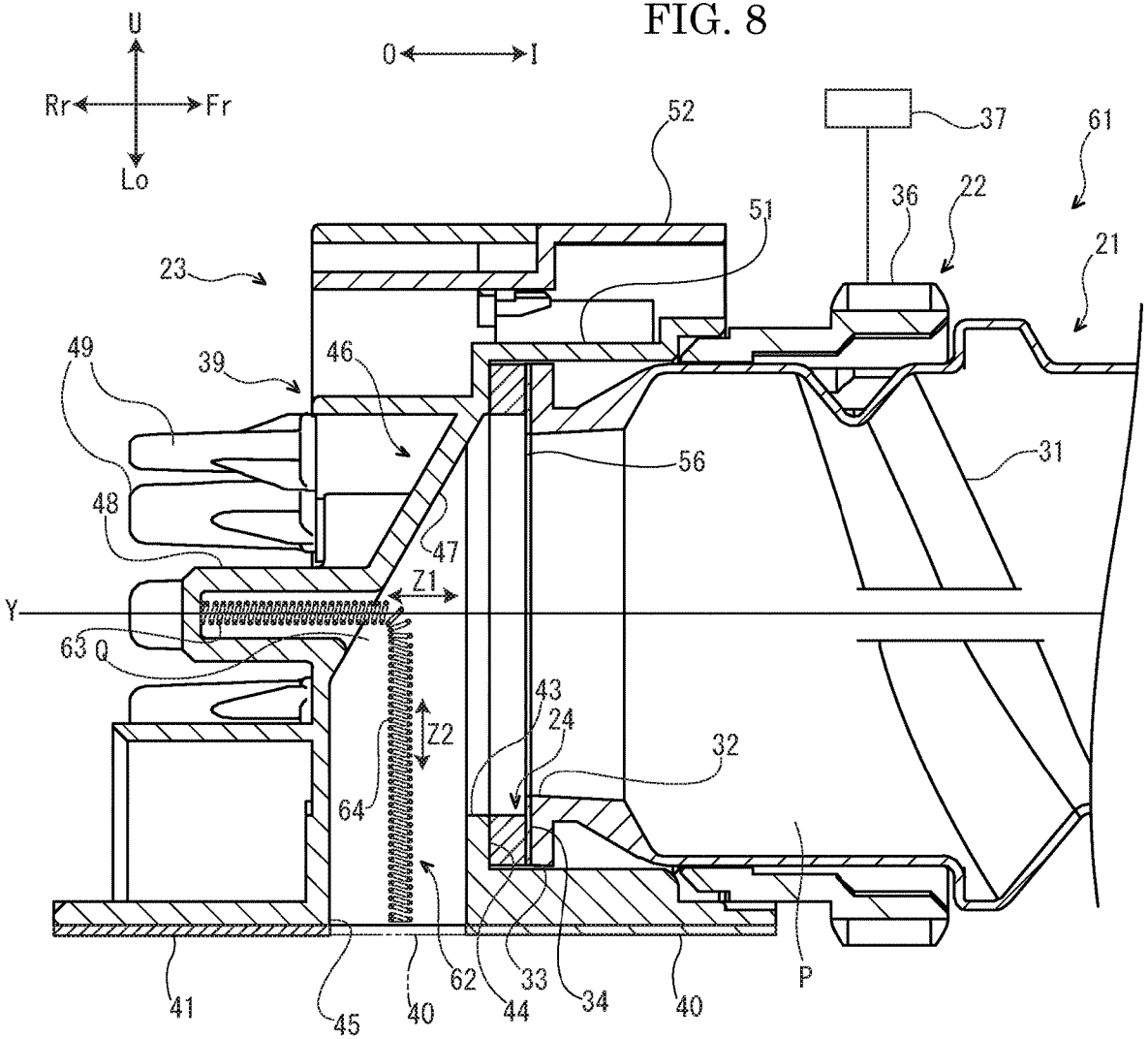
FIG. 8 is a sectional view showing a state where a shutter is in an opening position, in a toner bottle according to a second embodiment of the present disclosure.

As shown in FIG. 8, the coil spring 62 is formed by bending one coil spring, and is formed in an L shape. The coil spring 62 includes a first spring 63 which linearly extends along the front-and-back direction (horizontal direction) and a second spring 64 which is bent downward from a front end (an end in a side of the communication space Q) of the first spring 63 and linearly extends from the communication space Q to the toner supplying port 45 along the up-and-down direction. A part (a part except a front end) from a rear end to a front part of the first spring 63 is arranged in the boss 48 of the cover main body 39. According to this, the first spring 63 is fixed to the cover main body 39. The second spring 64 protrudes upward from the toner supplying port 45. In the state where the shutter 40 is in the closing position (see a two-dot chain line in FIG. 8), a lower end of the second spring 64 is arranged above the shutter 40.

As the case main body 21 rotates in the toner bottle 61 configured as described during toner supply, the case main body 21 vibrates accordingly. The vibration of the case main body 21 is transmitted to the first spring 63 of the coil spring 62 via the cover main body 39, so that the first spring 63 vibrates. When the first spring 63 vibrates in this way, this vibration is transmitted to the second spring 64 of the coil spring 62, and the second spring 64 vibrates in the front-and-back direction and the up-and-down direction (see arrows Z1 and Z2 in FIG. 8). According to this, similar to the first embodiment, it is possible to resolve the aggregated particles T in the communication space Q.

In the present embodiment, as mentioned above, the first spring 63 of the coil spring 62 is fixed to the cover main body 39. By employing such a configuration, it is possible to determine an arrangement of the coil spring 62 irrespectively of an arrangement and a motion of the shutter 40, and increase the degree of freedom of the arrangement of the coil spring 62.

Further, the coil spring 62 includes the first spring 63 which is fixed to the cover main body 39 and extends along the front-and-back direction, and the second spring 64 which is bent downward from the first spring 63, and extends from the communication space Q to the toner supplying port 45 along the up-and-down direction. By employing such a configuration, the vibration of the cover main body 39 can be amplified by the first spring 63 and then transmitted to the second spring 64. Consequently, it is possible to increase the amplitude of the vibration of the second spring 64, and further enhance an effect of resolving the aggregated particles T.

Further, a part of the first spring 63 is arranged in the boss 48 of the cover main body 39. By employing such a configuration, it is possible to fix the first spring 63 to the cover main body 39 by using a simple configuration.

In the present embodiment, the case where the first spring 63 and the second spring 64 are formed by bending one coil spring has been described. Meanwhile, in another embodiment, two coil springs may be combined to form the first spring 63 and the second spring 64. That is, the first spring 63 and the second spring 64 may be formed by different coil springs, respectively.

In the first embodiment, the linear coil spring 25 has been used, and, in the present embodiment, the L-shaped coil spring 62 has been used. Meanwhile, in another embodiment, a coil spring having a shape other than a linear shape or an L shape, such as a U shape or an arc shape, may be used.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body being rotatable and having a toner containing space in which a toner is contained and an opening through which the toner is discharged from the toner containing space;

a cover keeping a rotation stop state when the case main body rotates and having a communication space which communicates with the toner containing space via the opening; and a coil spring fixed to the cover so that at least a part of the coil spring is arranged in the communication space, the coil spring vibrating as the case main body rotates, wherein the cover includes:

a cover main body having the communication space and a toner supplying port through which the toner is discharged from the communication space; and a shutter being movable between an opening position where the shutter opens the toner supplying port and a closing position where the shutter closes the toner supplying port, and the coil spring is fixed to the shutter.

2. The toner case according to claim 1, wherein the toner supplying port is arranged at a lower end side of the communication space, and the shutter is arranged along a horizontal direction, and the coil spring extends along an up-and-down direction from the toner supplying port to the communication space.

3. The toner case according to claim 1, wherein the coil spring includes a pair of wound parts which lies next to each other, the pair of wound parts nipping a distal end of the shutter so that the coil spring is fixed to the shutter.

4. The toner case according to claim 3, wherein the cover further includes a seal arranged along the toner supplying port, and a border between the pair of wound parts separates from the seal in a state where the shutter is in the opening position and the border comes into contact with the seal when the shutter is in the closing position.

5. The toner case according to claim 1, wherein the coil spring is fixed to a face of the shutter, the face being arranged in a side of the communication space.

6. A toner case comprising:

a case main body being rotatable and having a toner containing space in which a toner is contained and an opening through which the toner is discharged from the toner containing space;

a cover keeping a rotation stop state when the case main body rotates and having a communication space which communicates with the toner containing space via the opening; and a coil spring fixed to the cover so that at least a part of the coil spring is arranged in the communication space, the coil spring vibrating as the case main body rotates, wherein the cover includes:

a cover main body having the communication space and a toner supplying port through which the toner is discharged from the communication space; and a shutter being movable between an opening position where the shutter opens the toner supplying port and a closing position where the shutter closes the toner supplying port, and the coil spring is fixed to the cover main body, wherein the toner supplying port is arranged at a lower end side of the communication space, and the shutter is arranged along a horizontal direction, and the coil spring includes:

a first spring fixed to the cover main body and extending along the horizontal direction; and a second spring bent downward from the first spring and extending along an up-and-down direction from the communication space to the toner supplying port.

7. The toner case according to claim 6, wherein the cover main body includes a cylindrical boss extending along the horizontal direction toward a side separating from the communication space, and at least a part of the first spring is arranged in the boss.

8. The toner case according to claim 6, wherein a lower end of the second spring is arranged above the shutter in a state where the shutter is in the closing position.

9. The toner case according to claim 1, wherein a spiral conveying rib is arranged on an inner circumferential face of the case main body, and the conveying rib conveys the toner contained in the toner containing space so that the toner is discharged from the toner containing space via the opening and introduced to the communication space, as the case main body rotates.

10. An image forming apparatus comprising the toner case according to claim 1.

* * * * *